US005743474A

United States Patent [19]

Stevenson

[11] Patent Number: 5,743,474

[45] Date of Patent: Apr. 28, 1998

[54] MACERATOR

[75] Inventor: Christopher Stevenson, Bredbury Park, United Kingdom

[73] Assignee: Mono Pumps Limited, United Kingdom

[21] Appl. No.: 556,757

[22] Filed: Nov. 2, 1995

[30] Foreign Application Priority Data

Nov. 23, 1994 [GB] United Kingdom ..... 9423623

[51] Int. Cl.[6] ..... B02C 18/40

[52] U.S. Cl. ..... 241/46.06; 241/81; 241/236

[58] Field of Search ..... 241/81, 46.06, 241/236, 186.3

[56] References Cited

U.S. PATENT DOCUMENTS

| | | | |
|---|---|---|---|
| 4,288,038 | 9/1981 | Williams | 241/81 X |
| 4,408,724 | 10/1983 | Meyer | 241/46.17 |
| 4,730,790 | 3/1988 | Williams | 241/81 |
| 5,366,167 | 11/1994 | McCarthy | 241/81 |

FOREIGN PATENT DOCUMENTS

| | | |
|---|---|---|
| 0 532 145 | 3/1993 | European Pat. Off. . |
| 1416796 | 9/1965 | France . |
| 1 472 705 | 1/1975 | United Kingdom . |

*Primary Examiner*—Mark Rosenbaum
*Attorney, Agent, or Firm*—Harness, Dickey & Pierce, P.L.C.

[57] ABSTRACT

A macerator (32), e.g. for sewerage, including two stacks of interleaved contra-rotating cutters and spacers is mounted in a macerator chamber (30) having an inlet (60) and an outlet (62). The chamber (32) has a sump (80) upstream of the stacks of the cutters, which are mounted at such an angle that hard, solid material such as stones and metal fall under gravity through the influent into the sump.

1 Claim, 3 Drawing Sheets

MACERATOR

The present invention relates to macerators. Various forms of macerators have been proposed, for example for inclusion in a sewerage treatment line. An early and relatively simple form is that disclosed in GB-A-1569672 in which the macerator comprises a macerating chamber, including an inlet and an outlet for inflow of material to be macerated and the outflow of macerated material, side walls of said chamber, first and second parallel contra-rotating shafts extending through said chamber between said side walls, a plurality of alternate cutters and spacers of the same nominal axial thickness mounted on each of said first and second shafts, to form a stack, the cutters of the first shaft being interleaved with those of the second shaft and comprising at least one tooth. In this structure the teeth are symmetrical, the idea being that the cutters can be turned round when the leading edges wear.

A modified version of such a structure is disclosed in EP-A-0454922 in which a rather different type of cutter is disclosed providing improved results.

A further improvement is shown in EP-A-0532145 in which the side rail, which may be incorporated in the macerator chamber, is provided with angled slots to facilitate the passage of excess fluid and yet prevent the passage of relatively thin material, such as plastics films or the like.

One problem which can occur with all these arrangements when used in a sewerage treatment line, is that sometimes very hard solid materials, such as stones, pieces of metal etc. do get entrained, particularly when storm water is involved. These can have a very damaging effect on the cutters and can cause seizure of the macerator.

It is now proposed, according to the present invention, to provide a macerator in which the macerating chamber includes a sump disposed at a location lower than the stack of alternate cutters and spacers between the inlet and the stack, whereby relatively heavy solid material is caused to drop into the sump and does not pass into the cutters with the remainder of the inflowing material.

Such a structure enables the more heavy materials, such as stones, pieces of metal etc. to drop under gravity through the influent, which is usually not very viscous, into the sump where it can, from time to time, be removed by the provision of a suitable closeable discharge opening. These hard materials therefore do not find their way into the cutter bank of the macerator and therefore the problem of damage to these cutters is alleviated. If some hard materials do reach the cutters they will be rejected and drop into the sump.

The plane which includes the axes can be vertical or is preferably inclined so that the upper part of the plane extends towards the inlet, thereby more clearly ensuring that the solid materials do not in any way get into the bank of cutters.

In order that the present invention may more readily be understood, the following description is given merely by way of non-limitative example with reference to the accompanying drawings, in which.

Figure 1:
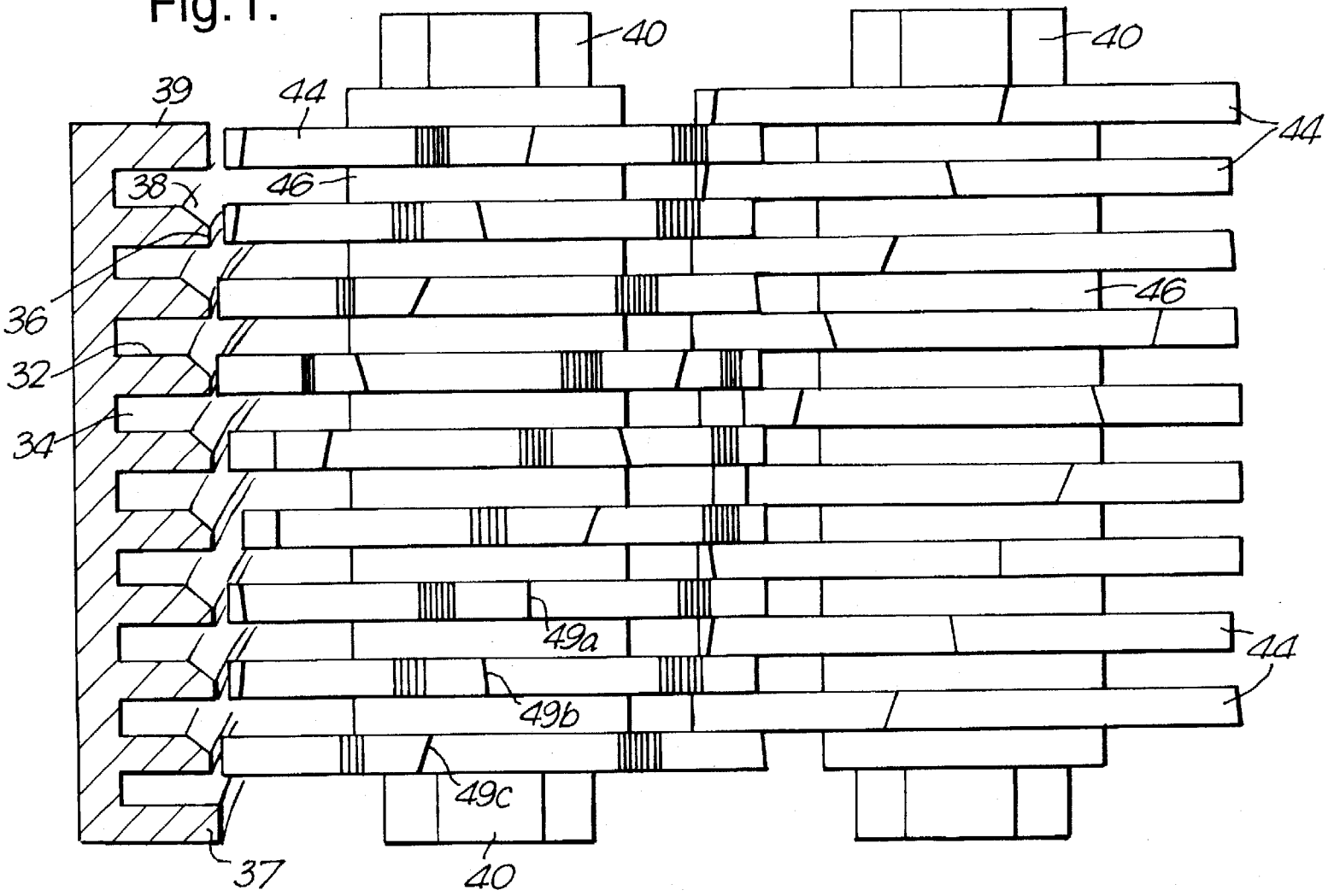
FIG. 1 is a side elevation of a know form of macerator as disclosed in EP-A-0532145, the disclosure of which is incorporated herein by reference.

If reference is first made to FIG. 1, two shafts 40 are shown mounted above parallel axes and each carries a macerator stack 42 comprising a plurality of cutters 44 alternating with spacers 46, the cutters and spacers being of the same thickness. There is an axial displacement of the cutters on one shaft as compared with those on the other, so that the cutters are interleaved one with the other. Side walls, which in this embodiment are in the form of side rails 30 are located adjacent each stack of cutters and includes upper and lower chamfered faces 30*a*,30*b* and angled ribs 32 defining slots 34 therebetween, the ribs 32 ensuring that liquid borne solid material flowing through a slot crosses a plane of at least two cutting elements 44. Each cutter of a stack including five teeth 48 and each tooth has a front cutting face 48*a* and a tip of which three 49*a*,49*b* and 49*c* can be seen in FIG. 1. Crossing the plane of several cutting elements increases the likelihood that a piece of solid material which might have passed down one of the slots 34 will contact the cutting elements 44 several times and be adequately reduced to a manageable particle size.

Figure 2:
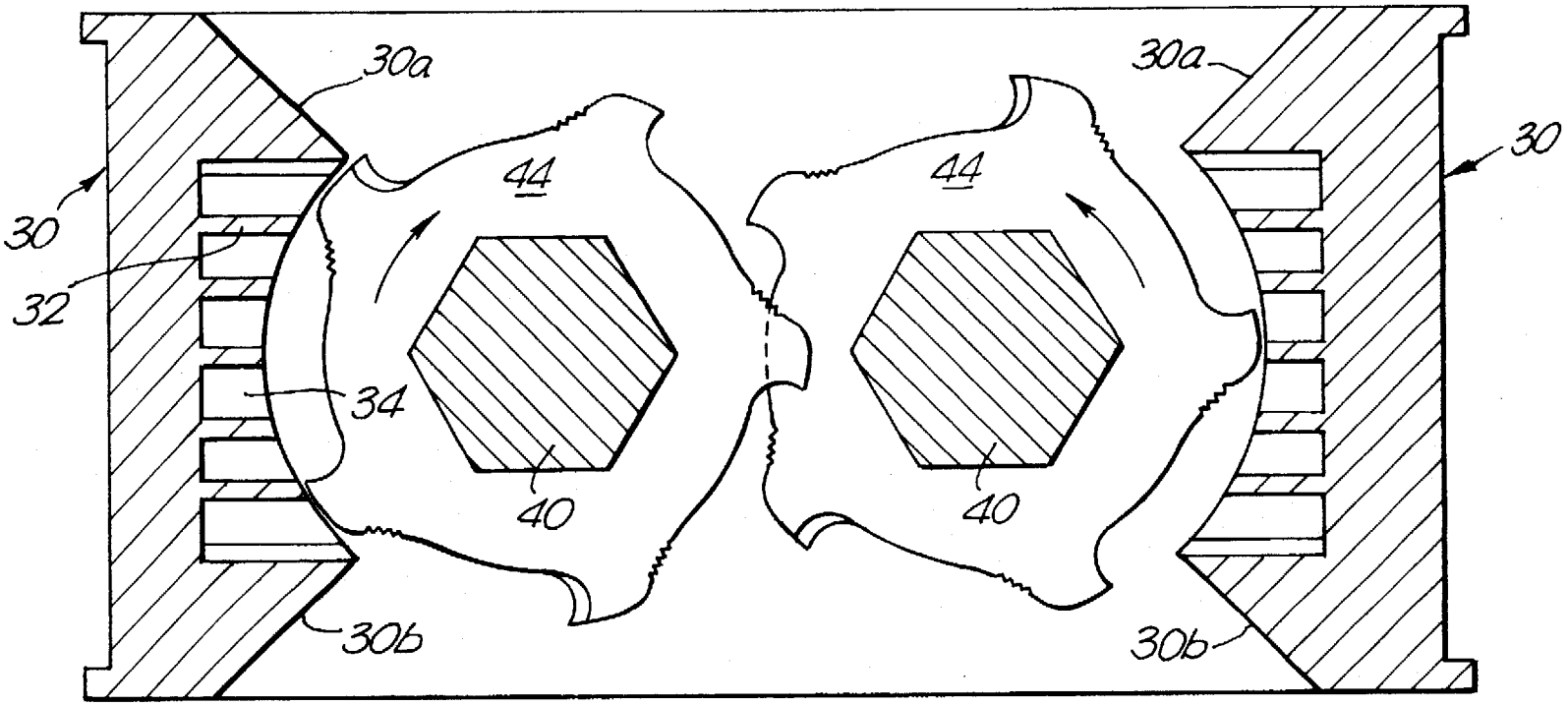
FIG. 2 is a reduced cross-section on a plane perpendicular to the axes of the stacks showing the relative position of the side rail ribs and slots of the cutters.

This is shown more clearly in FIG. 2. In the embodiment shown therein. The left-hand shaft 40 (FIG. 2) rotates clockwise and the right-hand shaft anticlockwise and hence material is fed vertically downwardly, that is to say the inlet is at the top. This is a fairly standard orientation and has the problems enumerated above.

Figure 3:
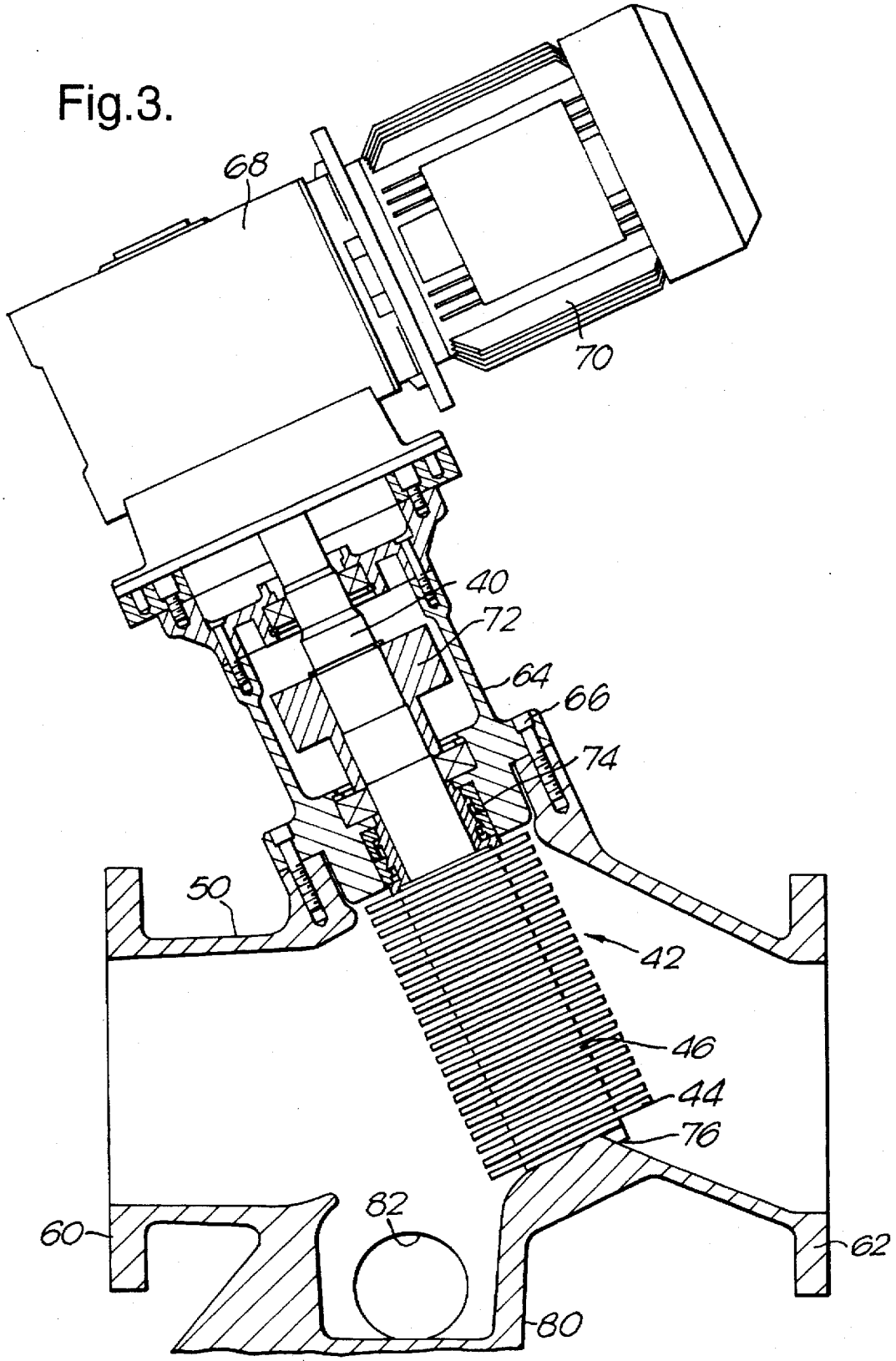
FIG. 3 shows an arrangement of macerator according to the present invention in three different formats.

As can be seen in FIG. 3, according to the invention, the casing 50 is provided with a horizontal inlet 60 and a horizontal outlet 62 on opposite sides of the stack 42. The upper surface of the housing 50 is angled at about 30° to the horizontal and a pull back bearing housing 64 is retained in place by a bolt 66 so that the axis of the shafts 40 are at an angle of 60° to the horizontal. This angle can vary between 40° and 70°.

One of the two shafts 40 is driven via a gear box 68 which in turn has its drive provided by a motor 70 and rotation of the other of the two shafts is effected by transfer gears 72 in the form of a close ratio gear set to give the driven shaft the correct differential speed to the drive shaft.

Mechanical seals 74 are provided, two per machine only, which provide a very adequate seal. It will be noted that the lower end of the main shafts 40 abut an inclined portion 76 of the housing and hence the main shaft is cantilevered downwardly thereby eliminating the need for bottom seals and bearings.

The lower part of the housing 50 is provided with a sump 80, on the inlet side of the stack 42 and rejected objects can be removed via clean-out ports indicated by the reference numeral 82.

Material to be macerated is introduced via a pipeline at 60 and flows through the stack of cutters 42 to macerated thereby and the resulting macerated material exits through the outlet 62 to a suitable location.

Rather heavy materials such as stones, pieces of metal etc., which would normally damage the macerator cutters, fall under gravity into the sump 80 and can readily be removed.

I claim:

1. A macerator comprising a macerating chamber, an inlet and an outlet to said chamber for the inflow of material to be macerated and the outflow of macerated material, respectively, side walls of said chamber, a macerator stack mounted in said chamber, said macerator stack comprising first and second parallel contra-rotating shafts extending through said chamber between said side walls, a plurality of alternate cutters and spacers of the same nominal axial thickness mounted on each of said first and second shafts, to form a stack, the cutters of the first shaft being interleaved with those of the second shaft, at least one tooth formed on each cutter, each tooth having a front cutting face, the portion of the macerator chamber between the inlet and the macerator stack forming an inlet chamber, said parallel shafts having axes included in a plane which is inclined at an angle to the horizontal, with the upper part of the plane nearer to the inlet than the lower part of the plane and a sump forming a lower part of said inlet chamber, said sump being at a location directly below the inclined macerator stack within the macerator chamber, effective to cause relatively heavy solid material to be caused to drop or be rejected by the cutters and drop into the sump, whereby it does not pass into the cutters with the remainder of the inflowing material.

* * * * *